US007156750B2

(12) United States Patent
Nishitani et al.

(10) Patent No.: US 7,156,750 B2
(45) Date of Patent: Jan. 2, 2007

(54) GOLF CLUB HEAD

(75) Inventors: Masafumi Nishitani, Tokyo (JP); Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 3 days.

(21) Appl. No.: 10/765,566

(22) Filed: Jan. 28, 2004

(65) Prior Publication Data

US 2004/0254030 A1 Dec. 16, 2004

(30) Foreign Application Priority Data

Jan. 29, 2003 (JP) ..... P. 2003-020670

(51) Int. Cl.
*A63B 53/04* (2006.01)

(52) U.S. Cl. ..... 473/329; 473/345; 473/349

(58) Field of Classification Search ..... 473/324–350
See application file for complete search history.

(56) References Cited

U.S. PATENT DOCUMENTS

| | | | | |
|---|---|---|---|---|
| 708,575 | A * | 9/1902 | Mules | 473/329 |
| 727,819 | A * | 5/1903 | Mattern | 473/329 |
| 5,106,094 | A * | 4/1992 | Desbiolles et al. | 473/342 |
| 5,205,560 | A | 4/1993 | Hoshi et al. | |
| 5,255,913 | A | 10/1993 | Tsuchida | |
| 5,346,217 | A | 9/1994 | Tsuchiya et al. | |
| 5,755,627 | A | 5/1998 | Yamazaki et al. | |
| 6,001,495 | A * | 12/1999 | Bristow et al. | 428/660 |
| 6,348,013 | B1 | 2/2002 | Kosmatka | |
| 6,878,073 | B1 * | 4/2005 | Takeda | 473/346 |
| 2003/0125127 | A1 * | 7/2003 | Nakahara et al. | 473/329 |
| 2005/0026719 | A1 * | 2/2005 | Yang | 473/342 |
| 2005/0096154 | A1 * | 5/2005 | Chen | 473/345 |
| 2005/0119068 | A1 * | 6/2005 | Onoda et al. | 473/342 |
| 2005/0159243 | A1 * | 7/2005 | Chuang | 473/345 |

FOREIGN PATENT DOCUMENTS

| | | | |
|---|---|---|---|
| JP | 3-126474 | A | 5/1991 |
| JP | 4-82574 | A | 3/1992 |
| JP | 4-135576 | A | 5/1992 |
| JP | 2268412 | A * | 1/1994 |
| JP | 7-112041 | A | 5/1995 |
| JP | 7-155410 | A | 6/1995 |
| JP | 9-215786 | A | 8/1997 |
| JP | 10015118 | A * | 1/1998 |
| JP | 2002052099 | A * | 2/2002 |
| JP | 2002-119625 | A | 4/2002 |
| JP | 2003-52866 | A | 2/2003 |
| JP | 2004008409 | A * | 1/2004 |

* cited by examiner

*Primary Examiner*—Sebastiano Passaniti
(74) *Attorney, Agent, or Firm*—Sughrue Mion, PLLC

(57) ABSTRACT

A golf club head includes a front body, a middle body, a back body integrally. The middle body is disposed between the front body and the back body. The middle body includes a middle crown constituting a middle portion of a crown portion in back and forth directions, a middle side constituting middle portions of both side surfaces on a toe side and a heel side in the back and forth directions, a middle sole constituting a middle portion of a sole portion in the back and forth directions. The middle body may include aluminum alloy. The front body and the back body may include titanium alloy.

24 Claims, 3 Drawing Sheets

GOLF CLUB HEAD

BACKGROUND OF THE INVENTION

1. Field of the Invention

The present invention relates to a hollow golf club head, and particularly relates to a golf club head having a wood type shape or another shape close to the wood type shape.

2. Description of the Related Art

Hollow golf club heads made from metal are used broadly as wood type golf club heads such as drivers or fairway woods. Generally, as shown in FIG. 3, a wood type hollow golf club head 1 includes a face portion 2 for hitting a ball therewith, a crown portion 3 forming the top portion of the golf club head, a sole portion 4 forming the bottom portion of the golf club head, a side portion 5 forming the side portion on the toe side, back side and heel side of the golf club head, and a hosel portion 6. A shaft 7 is inserted into the hosel portion 6 of the golf club head 1, and fixed thereto by an adhesive agent or the like. Incidentally, recently, many golf club heads called utility golf club heads have appeared on the market. As one kind of utility golf club head, various golf club heads similar to the wood type golf club head (that is, including a face portion, a sole portion, a side portion and a crown portion) are available on the market.

Aluminum alloys, stainless steel or titanium alloys are available as metal for forming such hollow golf club heads. Of them, titanium alloys have been used broadly in recent years.

JP-A-2002-119625 discloses a golf club head in which a face portion is made thicker than a crown portion, the crown portion is curved upward, and the face portion and the crown portion are molded integrally by press working.

JP-A-Hei.7-155410 discloses a golf club head in which the rear half side thereof is made from high-specific-gravity metal such as stainless steel or brass, while the front half side thereof is made from a low-specific-gravity material such as CFRP, titanium, or aluminum.

JP-A-Hei.7-112041 discloses a golf club head in which a crown portion is made from CFRP, and a sole portion is made from aluminum, while the other head body portion is made from stainless steel, a titanium alloy or a copper alloy.

In order to increase the carry of a shot with a metal hollow golf club head, development has been made and aimed at increasing the repulsion of a ball by use of bending of the face surface, to thereby hit the ball farther. However, when a golfer having a low head speed uses such a golf club head, the deformation of the face surface is so small that the effect of increasing the initial velocity of A ball is insufficient. In addition, a low trajectory of the ball may hinder increase of the carry.

According to the golf club head disclosed in JP-A-2002-119625, the crown portion is bent upward as soon as a ball is hit, so that the repulsion of the ball is enhanced. However, in the golf club head disclosed in the same publication, the rear portion of the golf club head is also thin so that the moment of inertia is relatively small.

In the golf club head disclosed in JP-A-Hei.7-155410, the specific gravity of the head rear portion is so heavy that the head is badly balanced in weight.

In the golf club head disclosed in JP-A-Hei.7-112041, the side portion is continuously integrated with the head rear portion and the head front portion including the face portion, so that the bending of the crown potion when a ball is hit is not always sufficient.

SUMMARY OF THE INVENTION

It is an object of the invention to provide a golf club head in which the moment of inertia is increased so that the sweet area can be expanded, while the crow portion is sufficiently easy to bend so that the launch angle is increased and the carry can be consequently increased even when a golfer having a low head speed uses the golf club head.

According to an embodiment of the invention, a hollow golf club head includes a front body, a back body, and a middle body. The front body includes a face portion. The middle body is disposed between the front body and the back body and extends from a toe side of a side portion to a heel side of the side portion through a crown portion bending upwardly. Material of the middle member is lower in longitudinal elastic modulus and specific gravity than material of the front body and material of the back body.

In the golf club head according to the embodiment of the invention, at least, the crown portion and the side portions on the toe side and the heel side include the middle body, which is lower in longitudinal elastic modulus and specific gravity than material of the front body and material of the back body. The middle body is light, and is lower in longitudinal elastic modulus and specific gravity than material of the front body and material of the back body, not only in the crown portion but also in the side portions on the toe side and the heel side.

Thus, the crow portion bends sufficiently at the time of impact so that the launch angle of a ball can be increased. As a result, even when a golfer having a low head speed uses the golf club head, the launch angle is increased so that the carry can be increased. In addition, the moment of inertia is so high that the sweet area can be expanded.

The material of the front body may include at least one of titanium and titanium alloy. The material of the back body may include at least one of titanium and titanium alloy. The material of the middle member may include at least one of metal and alloy, which have melt point equal to or lower than 700° C. When the front body and the back body are disposed in a mold and metal or alloy liquid at 700° C. or lower is then charged between the front body and the back body, the golf club head including the middle body can be formed easily.

Alternatively, the material of the front body may include at least one of titanium and titanium alloy. The material of the back body may include at least one of titanium and titanium alloy. The material of the middle body may include carbon fiber reinforced plastic. This is golf club head including the middle body can be formed easily as follows. That is, the front body and the back body are disposed in a mold, and prepreg as a raw material of the middle body is then disposed between the front body and the back body. The prepreg is expanded by air pressure so as to be brought into close contact with the inner surface of the mold while being made continuous to the front body and the back body. Thus, the golf club head including the middle body can be formed easily. The specific gravity of the solidified prepreg is so small to be 1.4–1.7 that the center of gravity of the golf club head becomes low.

According to the embodiment of the invention, a hollow golf club head includes at least one of titanium and titanium alloy. The golf club head includes a front body, a back body, and a middle body. The front body includes a face portion. The middle body is disposed between the front body and the back body and extends from a toe side of a side portion to a heel side of the side portion through a crown portion bending upwardly. The middle body is thinner than the front body and the back body. It is preferable that the front body has thickness in a range of 0.8 mm to 1.2 mm; that the back body has thickness in a range of 0.8 mm to 1.2 mm; and that the middle body has thickness in a range of 0.6 mm to 1.2 mm.

In this golf club head, not only the crown portion but also the side portion on the toe side and the heel side are so thin that the golf club head is also light in weight. In addition, the crown portion bends sufficiently at the time of impact so that the launch angle of a ball can be increased. As a result, even when a golfer having a low head speed uses the golf club head, the launch angle becomes so high that the carry can be increased. In addition, the moment of inertia is so high that the sweet area can be expanded.

In the golf club head according to the embodiment of the invention, the sole portion, the side portion of the back portion may be thick in a range of 1.2 mm to 4.0 mm. In such a manner, the center of gravity of the golf club head can be made low, or the depth of the center of gravity can be increased.

When the middle body is not disposed in the sole portion in the gold club head according to the invention, the center of gravity of the golf club head becomes so low that a ball (hit ball) becomes easy to rise.

In the golf club head according to the embodiment of the invention, the middle body may be present only in the crow portion and the side portions, and furthermore may be present in the sole portion. When the middle body includes at least part of the crown portion, at least part of a sole portion, and at least part of the side portion. When the middle body includes at least part of the crown portion and at least part of the side portion, it is preferable that a ratio of an area of the middle body to an entire outer surface area of the golf club head is in a range of 5% to 33%. When the middle body includes at least part of the crown portion, at least part of a sole portion, and at least part of the side portion, it is preferable that a ratio of an area of the middle body to an entire outer surface area of the golf club head is in a range of 8% to 35%.

In the invention, it is preferable that the middle body includes the highest (top) point of the crown portion. The middle body may have a slit-like shape 10–20 mm wide.

DETAILED DESCRIPTION OF THE PREFERRED EMBODIMENTS

Figure 1:
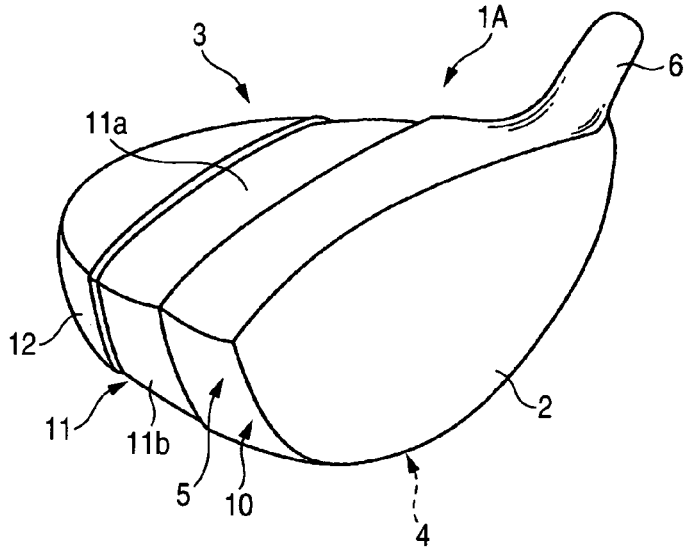
FIG. 1(*a*) is a perspective view of a golf club head according to an embodiment of the invention, FIG. 1(*b*) is a side view thereof, and FIG. 1(*c*) is a sectional view thereof.
Figure 1:
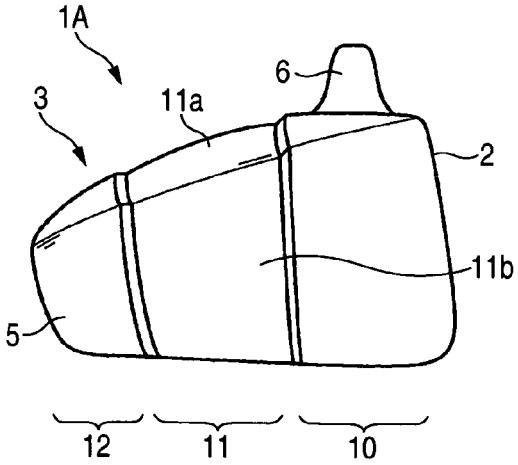
Figure 1:
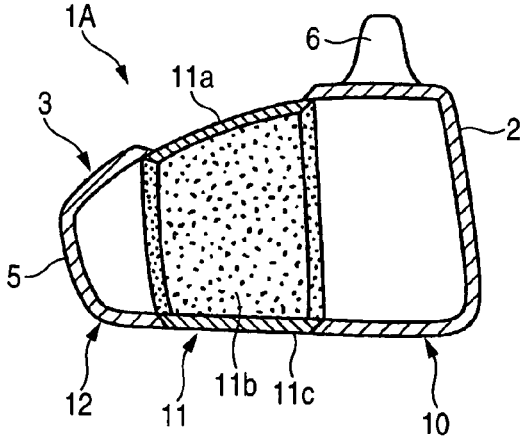

Embodiments will be described below with reference to the drawings. FIGS. 1(*a*), 1(*b*) and 1(*c*) area perspective view, a side view and a sectional view of a golf club head according to an embodiment.

A golf club head 1A includes a face portion 2, a crown portion 3, a sole portion 4, a side portion 5 and a hosel portion 6. The golf club head 1A is formed out of a front body 10, a middle body 11 and a back body 12 integrated with one another.

The front body 10 forms the front portion of the golf club head 10 and includes the face portion 2, a crown portion front edge, a side portion front edge and a sole portion front edge, which are connected to the face portion 2, and the hosel portion 6. The face portion 2 is provided with score-lines (grooves) in accordance with necessity.

The back body 12 forms the rear portion of the golf club head and includes a rear edge of the crown portion 3, opposite side surfaces (heel-side and toe-side side surfaces) of the rear portion of the side portion, a back surface of the side portion, and a rear edge of the sole portion.

The middle body 11 is located between the front body 10 and the back body 12. The middle body 11 is provided with a middle crown 11*a* forming the front/rear-direction intermediate portion of the crown portion 3, a middle side 11*b* forming the front/rear-direction intermediate portions of the toe-side and heel-side side surfaces of the side portion 5, and a middle sole 11*c* forming the front/rear-direction intermediate portion of the sole portion 4. The middle body 11 has an annular shape surrounding the golf club head in the toe-heel direction.

In this embodiment, the middle body 11 is made from an aluminum alloy while each of the front body 10 and the back body 12 is made from a titanium alloy. It is preferable that the average thickness of the middle body 11 is 60–100%, particularly about 80–90% of the average thickness of the crown portion and the side portion in the front body 11 and the back body 12.

The front body 10 and the back body 12 are preferably produced by forging or casting in advance. More preferably each body 10, 12 is a forging. The melting point of a titanium alloy or stainless steel is about 1,400–1,600° C. while the melting point of an aluminum alloy or a magnesium alloy is low to be about 600–700° C. It is,therefore a casting is preferable.

To manufacture the golf club head 1A, a core for casting the middle body is disposed between the front body 10 and the back body 12, which are produced in advance and disposed in a mold. Aluminum alloy liquid is charged into the mold to form the middle body 11 and integrate the middle body 11 with the front body 10 and the back body 12. After release from the mold, deflashing and plating or painting are performed in accordance with necessity so as to form a golf club head.

Incidentally, in the crown portion 3 and the side portion 5 according to this embodiment, the middle crown 11*a* and the middle side 11*b* of the middle body 11 are formed to be one step lower than the crown portion and the side portion in the front body 10 and the back body 12 so that step surfaces are formed in the crown portion 3 and the side portion 5. With such a configuration, the seam between the middle body 11 and the front body 10 formed out of different kinds of raw materials and the seam between the middle body 11 and the back body 12 formed likewise are located in the step portions, respectively. Thus, the sense of discontinuity or mismatch in appearance caused on the seams by the difference in raw material is relieved. Incidentally, the color in appearance may be made to differ between the middle body 11 and the front body 10 and between the middle body 11 and the back body 12.

In the sole portion 4, the front body 11, the middle body 12 and the back body 12 are flush with one another. However, the middle body 11 may be made one step lower in the same manner as the crown portion 3 and the side portion 5.

In this embodiment, the width of the middle body 11 in the front/rear direction of the head is substantially uniform among the crown portion 3, the side portion 5 and the sole portion 4. However, the width may have a variation. Incidentally, it is preferable that the maximum width of the middle body 11 in the front/rear direction in the sole portion 4 is 10–50 mm, particularly 15–30 mm.

It is preferable that the external surface of the middle body 11 occupies 5–30%, particularly 8–25% of the whole external surface area of the golf club head 1A. In the crown portion 3, the middle body 11 preferably has a width of 10–50 mm, particularly 15–30 mm.

In the golf club head configured thus, the middle body 11 made from a low-specific-gravity aluminum alloy is disposed between the front body 10 and the back body 12 each made from a titanium alloy. The whole volume of the golf club head is larger than that of a golf club head having the same weight but wholly produced out of a titanium alloy with a uniform thickness. Accordingly, in comparison with a related-art golf club head having the same weight, the moment of inertia is increased so that the sweet area can be expanded.

In addition, in this golf club head, the longitudinal elastic modulus of the aluminum-alloy middle body 12 occupying the front/rear-direction intermediate portion of the crown portion is lower than that of the front body 11 and the back body 13 each made from a titanium alloy. Accordingly, the crown portion 3 bends largely at the time of impact so that the launch angle of a ball is high. Thus, even when a golfer having a low head speed uses the golf club head, a long carry can be obtained.

Incidentally, when the differences in longitudinal elastic modulus between the middle body and the front body and between the middle body and the back body are not smaller than 1,000 kgf/mm$^2$ ($9.8\times10^9$ Pa), particularly not smaller than 1,500 kgf/mm$^2$ ($14.7\times10^9$ Pa), the crown portion is bent more easily so that a longer carry can be obtained. Incidentally, when the differences in longitudinal elastic modulus between the middle body and the front body and between the middle body and the back body are too large, the launch angle is indeed high, but the repulsive force of a ball when the ball is hit is reduced so that the carry is reduced. It is therefore usually preferable that the differences are not larger than 3,000 kgf/mm$^2$ ($29.4\times10^9$ Pa), particularly not larger than 2,600 kgf/mm$^2$ ($24.5\times10^9$ Pa).

In the embodiment, the middle body 11 is made from an aluminum alloy. However, the middle body 11 may be made from a titanium alloy thinner than the front body 10 and the back body 12 in the crown portion (preferably 80–100%, particularly 90–95% as thick as the front body 10 and the back body 12). Differently from the aluminum-alloy middle body, the thin titanium-alloy middle body can be bonded by welding to the front body and the back body because the melting point is close to those of the front body and the back body. The middle body maybe integrated with the front body and the back body by casting. Alternatively, the middle body may be produced separately and then integrated with the front body and back body by welding such as laser welding or plasma welding. Laser welding or plasma welding is suitable for thin metal because deformation caused by welding is low.

Alternatively, the middle body 11 may be made from fiber reinforced synthetic resin such as carbon fiber reinforced plastics (CFRP).

To produce a golf club head including the middle body 11 made from fiber reinforced synthetic resin, the front body 10 and the back body 12 produced in advance are disposed in a forming mold. In addition, an internal pressure rubber bag whose outer circumference is surrounded by prepreg of fiber reinforced synthetic resin is disposed in the mold. Gas such as air is supplied to the internal pressure rubber bag so as to inflate the internal pressure rubber bag. Thus, the prepreg is brought into close contact with the inner surface of the mold and the inner surface edge portions of the front body and the back body. Next, the prepreg is heated and cured. Also in such a manner, the golf club head can be produced. In the front body, it is preferable that the crown portion and the side portion are made to have substantially one and the same thickness, while the face portion is 2–3 mm thick, and thicker than the crown portion.

Figure 2:
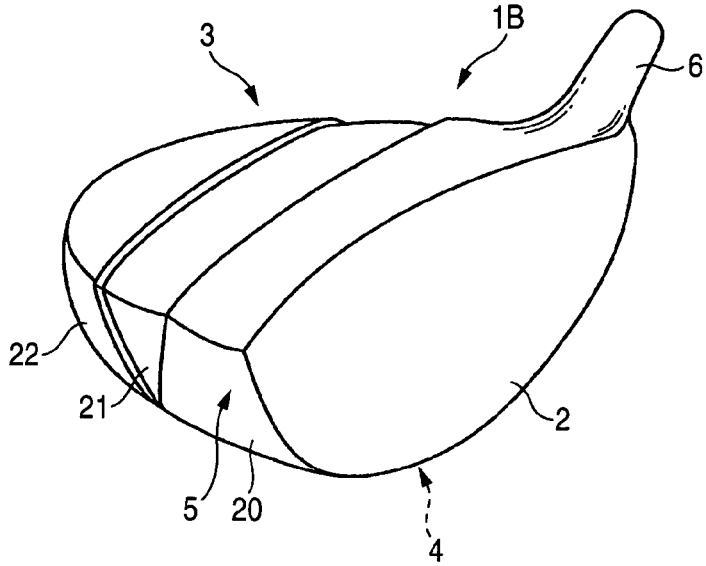
FIG. 2(*a*) is a perspective view of a golf club head according to another embodiment of the invention, FIG. 2(*b*) is a side view thereof, and FIG. 2(*c*) is a sectional view thereof.
Figure 2:
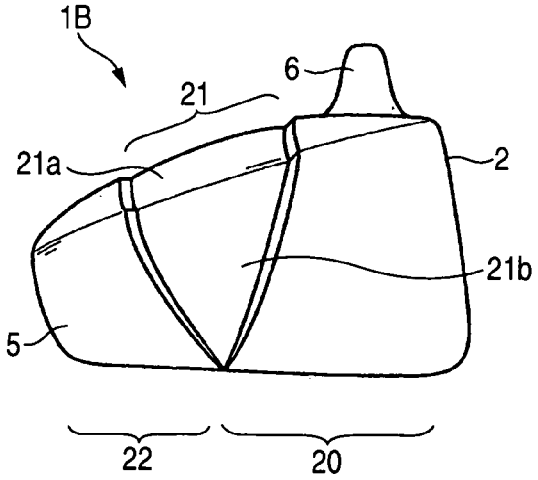
Figure 2:
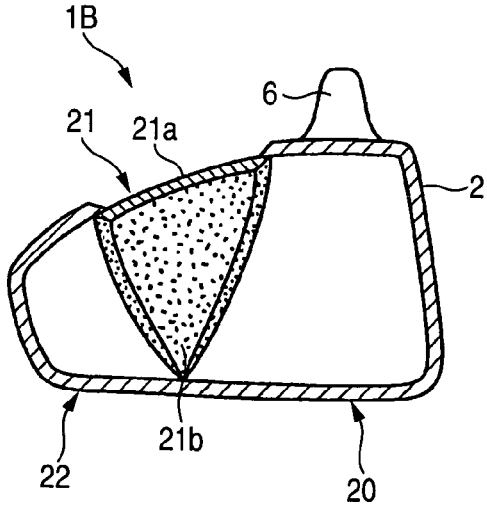
Figure 3:
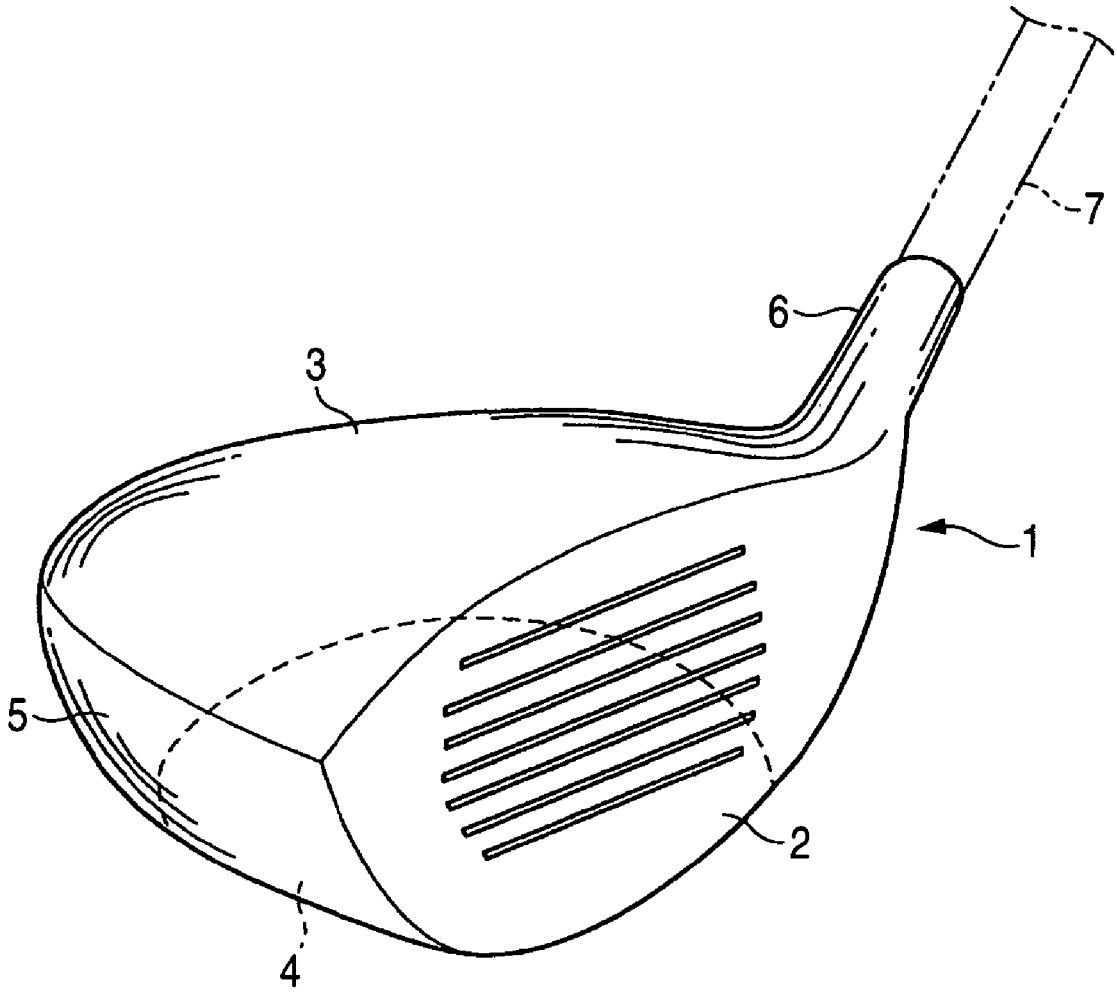
FIG. 3 is a perspective view of a related art golf club head.

A golf club head 1B according to another embodiment will be described with reference to FIG. 2.

This golf club head 1B includes a front body 20, a middle body 21 and a back body 22. The front body 20 and the back body 22 are coupled with each other continuously and integrally in the sole portion 4.

The middle body 21 is located in the front/rear-direction intermediate portion of the crown portion 3 and in the front/rear-direction intermediate portion of the side portion 5. In the crown portion 3, the middle body 21 includes of a middle crown 21 having a substantially uniform width in the toe/heel direction. In the side portion 5 on each of the toe-side and the heel-side, the middle body 21 includes a substantially inverted-triangular middle side 21*b* whose width is reduced as approaching its bottom. Although the middle side 21*b* reaches the sole portion 4 in this embodiment, the middle side 21*b* may be at a slight distance (for example, about 5–15 mm) from the sole portion 4.

It is desired that the constituent materials of the golf club head and the thickness and manufacturing method of each part of the golf club head are similar to those in the embodiment in FIG. 1. Incidentally, it is preferable that the average front/rear-direction width of the middle crown 21*a* is 10–50 mm, particularly 15–30 mm.

In this embodiment, it is preferable that the area of the external surface of the middle body 21 is 5–30% of the whole external surface area of the golf club head 1B, particularly 8–25%.

Also by the golf club head 1B according to this embodiment, operation and effect similar to those of the golf club head 1A can be obtained. Incidentally, the front body 20 and the back body 22 are integrated with each other in this embodiment. Thus, it is easy to manufacture the golf club head. In addition, the center of gravity is lower than that in the golf club head 1A. Thus, a ball (hit ball) is easy to rise.

Next, description will be made on metal materials forming the golf club head.

As the titanium alloy when the middle body 11, 21 is made from the titanium alloy, and as the titanium alloy for forming the back body 12, 22, a β type titanium alloy whose longitudinal elastic modulus is not higher than 10,500 kgf/mm$^2$ ($102.9\times10^9$ Pa) is preferable. Examples of such titanium alloys include Ti-15V-3Cr-3Sn-3Al, Ti-13V-11Cr-3Al, Ti-15Mo-5Zr, Ti-15Mo-5Zr-3Al, Ti-3Al-8V-6Cr-4Mo-4Zr, and Ti-22V-4Al.

As for the front body 10, 20, either the β type titanium alloy described above or an α-β type titanium alloy which will be described below may be used.

As for the back body 12, 22, α-β type titanium alloys such as Ti-6Al-4V and Ti-6Al-6V-2Sn and a near α type titanium alloy such as Ti-8Al-1Mo-1V, which have longitudinal elastic modulus not lower than 11,000 kgf/mm$^2$ ($107.8\times10^9$ Pa) maybe used. In addition, Ti-3Al-8V-6Cr-4Mo-4Zr and Ti-22V-4Al, which are β type titanium alloys heat-treated to have a longitudinal elastic modulus within the aforementioned range, can be also used.

Generally, the longitudinal elastic modulus of a β type titanium alloy varies in accordance with a difference in a heat treatment mode. The following Table 1 shows treatment modes and longitudinal elastic moduli of various titanium alloys and pure titanium and longitudinal elastic moduli of the titanium and the titanium alloys.

TABLE 1

| crystal structure | titanium alloy | longitudinal elastic modulus ($kg/mm^2$) | purpose | Preferred applicable part |
|---|---|---|---|---|
| β | Ti—15V—3Cr—3Sn—3Al | 10,200–10,500 | forging | crown member |
| β | Ti—13V—11Cr—3Al | 8,400–10,500 | forging | crown member |
| β | Ti—15Mo—5Zr | 7,800–12,000 | forging | crown member |
| β | Ti—15Mo—5Zr—3Al | 8,000–12,000 | forging | crown member |
| β | Ti—3Al—8V—6Cr—4Mo—4Zr | 10,700–12,600 | forging | crown member |
| β | Ti—22V—4Al | 8,900–11,000 | forging | crown member |
| α–β | Ti—6Al—4V | 11,500 | forging/casting | sole member |
| α–β | Ti—6Al—6V—2Sn | 11,300 | casting | sole member |
| near α | Ti—8Al—1Mo—1V | 12,700 | forging | sole member |
| | pure titanium | 10,850 | cutting/forging/casting | hosel member |
| α–β | Ti—3Al—2V (+S + rare earth) | 10,900 | cutting/forging/casting | hosel member |

Incidentally, in the heat treatment of the β type titanium alloy, it is preferable that age-hardening treatment is not performed on the material used for the top plate. Thus, the elastic modulate of the material is kept low. Also as for the headbody 10, a β type titanium alloy subjected to age-hardening treatment may be used.

Next, description will be made on preferred dimensions of the golf club head.

The invention is applied particularly effectively to a large-size golf club head whose crown portion is bent easily, and whose head volume is specifically not smaller than 250 cc, preferably not smaller than 300 cc, more preferably not smaller than 350 cc. Generally, the larger the volume of a golf club head is, the larger the weight of the golf club head is. When the weight is too large, it is difficult to swing a golf club with the golf club head smoothly. From the point of view of this restriction to weight, it can be therefore considered that the head volume has an upper limit of about 600 cc. The invention is preferably suitable for application to a driver head whose loft angle is 7°–15°.

It is preferable that the face height of the golf club head is higher. The higher the face height is, the larger the loft angle is when a ball is hit with an upper portion of the face surface. Specifically, it is preferable that the face maximum height is not smaller than 45 mm, particularly not smaller than 50 mm, more particularly not smaller than 53 mm. However, it is not preferable that the face height reaches 100 mm or more. In such a case, the wind pressure resistance of the face surface during a swing increases excessively.

When the golf club head is used as a driver head, the club length is typically about 43–50 inches. In consideration of swing balance, it is preferable that the head weight is about 165–205 g. When the head is too heavy, a general golfer is out of balance during a swing so that the golfer cannot take a full swing. When the head is too light, the repulsion of a ball may deteriorate.

As described above, according to the golf club head according to the embodiments of the invention, the moment of inertia is so high that the sweet area is wide, and even when a golfer having a low head speed uses the golf club head, the launch angle becomes so high that the carry can be increased.

What is claimed is:

1. A hollow golf club head comprising:

a front body including a face portion;

a back body; and a middle body disposed between the front body and the back body and extending from a toe side of a side portion to a heel side of the side portion through a crown portion bending upwardly, wherein:

the material of the middle body is lower in longitudinal elastic modulus and specific gravity than the material of the front body and the material of the back body.

2. The golf club head according to claim 1, wherein:

the material of the front body includes at least one of titanium and titanium alloy;

the material of the back body includes at least one of titanium and titanium alloy; and the material of the middle body includes at least one of metal and metal alloy.

3. The golf club head according to claim 2, wherein the at least one of the metal and the metal allow has a melt point equal to or lower than 7000° C.

4. The golf club head according to claim 1, wherein:

the material of the front body includes at least one of titanium and titanium alloy;

the material of the back body includes at least one of titanium and titanium alloy; and the material of the middle body includes carbon fiber reinforced plastic.

5. The golf club head according to claim 1, wherein the middle body includes at least part of the crown portion, at least part of a sole portion, and at least part of the side portion.

6. The golf club head according to claim 5, wherein a ratio of an area of the middle body to an entire outer surface area of the golf club head is in a range of 8% to 35%.

7. The golf club head according to claim 1, wherein the middle body includes at least part of the crown portion and at least part of the side portion.

8. The golf club head according to claim 7, a ratio of an area of the middle body to an entire outer surface area of the golf club head is in a range of 5% to 33%.

9. The golf club head according to claim 1, wherein the middle portion has a greater width nearer the crown than nearer a sole of the golf club head.

10. The golf club head according to claim 1, wherein the middle portion has a substantially inverted triangular shape when viewed from a side of the golf club head.

11. The golf club head according to claim 1, wherein at least a portion of an outer surface of the middle body forms a step with an outer surface of at least one of the front body and the back body.

12. The golf club head according to claim 1, wherein at least a portion of an outer surface of the middle body is formed a step lower than an outer surface of at least one of the front body and the back body.

13. A hollow golf club head including at least one of titanium and titanium alloy, the golf club head comprising:

a front body including a face portion;

a back body; and a middle body disposed between the front body and the back body and extending from a toe side of a side portion to a heel side of the side portion through a crown portion bending upwardly;

wherein the material of the middle body is thinner than the material of the front body and the material of the back body; and wherein the material of the front body and the material of the middle body comprise metal.

14. The golf club head according to claim 13, wherein the material of the middle body is at least 80% as thick as the material of the front body and the material of the back body.

15. The golf club head according to claim 14, wherein the material of the middle body is 90–95% as thick as the material of the front body and the material of the back body.

16. The golf club head according to claim 13, wherein the middle body also includes at least part of the side portion.

17. The golf club head according to claim 13, wherein at least a portion of an outer surface of the middle body forms a step with an outer surface of at least one of the front body and the back body.

18. The golf club head according to claim 13, wherein at least a portion of an outer surface of the middle body is formed a step lower than an outer surface of at least one of the front body and the back body.

19. The golf club head according to claim 13, wherein the middle body is also disposed in at least part of a sole portion of the club head.

20. The golf club head according to claim 13, wherein:

the front body comprises at least one of titanium, titanium alloy and magnesium alloy, the back body comprises at least one of titanium, titanium alloy and magnesium alloy, and the middle body comprises at least one of aluminum, aluminum alloy, titanium and titanium alloy.

21. A hollow golf club head including at least one of titanium and titanium alloy, the golf club head comprising:

a front body including a face portion;

a back body; and a middle body disposed between the front body and the back body and extending from a toe side of a side portion to a heel side of the side portion through a crown portion bending upwardly, wherein:

the middle body is thinner than the front body and the back body;

the front body has a thickness in a range of 0.8 mm to 1.2 mm;

the back body has a thickness in a range of 0.8 mm to 1.2 mm;

the middle body has a thickness in a range of 0.6 mm to 1.2 mm; and the a material of the middle body comprises metal.

22. The golf club head according to claim 21, wherein at least a portion of an outer surface of the middle body forms a step with an outer surface of at least one of the front body and the back body.

23. The golf club head according to claim 21, wherein at least a portion of an outer surface of the middle body is formed a step lower than an outer surface of at least one of the front body and the back body.

24. A hollow golf club head including at least one of titanium and titanium alloy, the golf club head comprising:

a front body including a face portion;

a back body; and a middle body disposed between the front body and the back body and extending from a toe side of a side portion to a heel side of the side portion through a crown portion bending upwardly;

wherein the material of the middle body is thinner than the material of the front body and the material of the back body; and wherein the middle body is also disposed in at least part of the side portion and tapers between a top and a bottom of the club head.

* * * * *